US005696065A

United States Patent [19]

Tanaka et al.

[11] Patent Number: 5,696,065

[45] Date of Patent: Dec. 9, 1997

[54] ENGINE OIL COMPOSITION

[75] Inventors: Noriyoshi Tanaka; Aritoshi Fukushima; Yukio Tatsumi; Kazuhisa Morita; Yoko Saito, all of Tokyo, Japan

[73] Assignee: Asahi Denka Kogyo K. K., Tokyo, Japan

[21] Appl. No.: 602,800

[22] PCT Filed: Jul. 4, 1995

[86] PCT No.: PCT/JP95/01333

§ 371 Date: Mar. 4, 1996

§ 102(e) Date: Mar. 4, 1996

[87] PCT Pub. No.: WO96/01302

PCT Pub. Date: Jan. 18, 1996

[30] Foreign Application Priority Data

Jul. 5, 1994 [JP] Japan ..... 6-175934
Aug. 29, 1994 [JP] Japan ..... 6-203503

[51] Int. Cl.[6] ..... C10M 135/18

[52] U.S. Cl. ..... 508/465; 508/486; 508/501

[58] Field of Search ..... 508/465, 486, 508/501

[56] References Cited

U.S. PATENT DOCUMENTS

| | | | |
|---|---|---|---|
| 2,173,117 | 9/1939 | Johnson | 508/501 |
| 4,175,047 | 11/1979 | Schick et al. | 508/501 |
| 4,178,258 | 12/1979 | Papay et al. | 508/363 |
| 5,160,645 | 11/1992 | Okaniwa et al. | 508/363 |
| 5,207,936 | 5/1993 | Anzai et al. | 508/363 |
| 5,356,547 | 10/1994 | Arai et al. | 508/376 |
| 5,494,608 | 2/1996 | Kamakura et al. . | |

FOREIGN PATENT DOCUMENTS

| | | |
|---|---|---|
| 62-275198 | 11/1987 | Japan . |
| 63-178197 | 7/1988 | Japan . |
| 3-23597 | 1/1991 | Japan . |
| 5-279688 | 10/1993 | Japan . |
| 5-311186 | 11/1993 | Japan . |

*Primary Examiner*—Prince Willis, Jr.
*Assistant Examiner*—Cephia D. Toomer
*Attorney, Agent, or Firm*—Oblon, Spivak, McClelland, Maier & Neustadt, P.C.

[57] ABSTRACT

The present invention is directed to provide an engine oil composition which fully exploits the performance of molybdenum dithiocarbamate (MoDTC), restricts degradation of MoDTC itself, and has a high MoDTC residual property even at the time of degradation, hence providing low friction and low wear for a long time, and which results in savings in fuel consumption. It is also directed to an engine oil composition having a high coefficient of friction and an extreme-pressure property under fluid lubricating conditions arising from extreme-pressures, in order to solve various problems encountered in friction. The engine oil compositions according to the present invention comprise a specific MoDTC, a specific zinc dithiophosphate and a base oil for engine oil as the essential components, and specific polyglycerin half esters may be further added.

6 Claims, No Drawings

ENGINE OIL COMPOSITION

INDUSTRIAL FIELD OF APPLICATION

This invention relates to an engine oil composition, more specifically, to an engine oil composition which is produced by blending molybdenum dithiocarbamate (hereinafter referred to as "MoDTC") and zinc dithiophosphate containing a primary alkyl group having 8 to 14 carbon atoms (hereinafter referred to as "ZnDTP") to a base oil for an engine oil, which has high residual MoDTC even when the oil degrades, hence providing low friction and low wear over a long period of time, leading to lower fuel consumption. The invention also relates to an engine oil composition which is produced by blending MoDTC, ZnDTP and polyglycerin half ester to a base oil for an engine oil, that is stable under fluid lubricating conditions from extreme pressure conditions and which has an excellent coefficient of friction.

PRIOR ART

Improvements in engine oils have been attempted in the past because of the promotion of energy conservation and technological progresses related to higher performance and higher output from automobiles, but the environment for engine oils has become more severe due to the rise of oil temperatures resulting from higher speeds and higher outputs of engines, deterioration of friction conditions, the limitations on oil capacity due to reductions in weight, the requirements for maintenance-free operation resulting from long drain, etc.

Engine oils play an important role in valve actuating systems, bearings, etc., in addition to their function as a lubricant between pistons and liners. Lubricating conditions differ depending on portions of the engine, and the performance required for engine oils has become diversified. In the piston portion, for example, a fluid lubricating condition is predominant. In this case, a lower viscosity engine oil plays the greatest role in reducing friction loss. When the viscosity of the engine oil is reduced, however, sealability deteriorates and wear increases. In the valve actuating system, on the other hand, lubrication is mainly mixed lubricating and boundary lubricating conditions. Accordingly, because reductions in engine oil viscosity has a negative effect on wear, additives having high extreme-pressure performance and high wear resistance become necessary.

In addition, the regulations on fuel consumption of automobiles and the restrictions on exhaust gases have become more severe due to environmental problems such as the greenhouse effect, emissions of nitrogen oxides ($NO_x$), etc. For these reasons, further improvements in mechanical efficiency such as from reductions in engine oil viscosity and excellent friction regulating additives are being sought.

As the viscosity of engine oils has been reduced, MoDTC and ZnDTP have been employed so as to reduce frictional loss, to prevent wear and to impart extreme-pressure properties, as additives for the base oil for engine oil. However, when these additives are merely mixed, the resulting engine oil compositions cannot substantially solve such problems as exhaust gas emissions, wear associated with the restrictions on fuel consumption drops in mechanical efficiency resulting from seizure and frictional loss, etc.

MoDTC undergoes deterioration as the oil deteriorates and eventually loses its friction reduction effect. Therefore, how to maintain the performance of MoDTC, particularly in engine oils, has been a critical problem that is yet to be solved. From the aspect of reducing engine oil viscosity or the fuel consumption by friction regulating additives, however, the use of MoDTC is essentially necessary at the present moment. In order to solve such problems as wear, drops in mechanical efficiency due to seizure and frictional loss, etc., therefore, it is necessary to fully exploit the performance of MoDTC, and from the aspect of long drain, too, an oil which maintains the performance of MoDTC even when the oil degrades and which exhibits a friction reduction effect for a long time must be developed.

In connection with ZnDTP, J. A. Spearot, F. Caracciolo et al report in SAE Paper 790941 (1979) that phosphorus (P) in engine oils lowers the functions of catalysts and $O_2$ sensors and deteriorates the purification ratios of CO, HC and $NO_x$ in exhaust gas. At present, attempts have been vigorously made to reduce the P content on the basis of the observation described above, but when wear resistance is considered in conjunction with the lower viscosity of engine oil, the addition of ZnDTP as a wear-proofing agent becomes inevitable. Even so, oils having a normal P content of more than 1,200 ppm are not presently being used as engine oils.

Under the circumstances described above, Japanese Patent Laid-Open No.63-178197 proposes a lubricating oil composition for a power transmission apparatus having a traction drive mechanism which composition is obtained by blending MoDTC and ZnDTP having a primary alkyl group to a base oil consisting of saturated hydrocarbon compounds having a condensed ring and/or an uncondensed ring as its principal component. In the composition of this patent application, however, the oil is a lubricating oil for the power transmission apparatus having the traction drive mechanism, though the composition uses MoDTC and ZnDTP. Since the application of this lubricating oil is different from that of an engine oil, its basic oil is specific, and performance as an engine oil cannot be expected.

Japanese Patent Publication No.3-23595 proposes a lubricating oil composition prepared by blending 0.2 to 5 percent by weight of MoDTC, 0.1 to 7 percent by weight of ZnDTP (at least 50% of which consists of ZnDTP having a secondary alkyl group), 0.1 to 20 percent by weight of calcium alkylbenzenesulfonate and 1 to 15 percent by weight of alkenylsuccinimido to 98.6 to 53 percent by weight of a mineral oil and/or synthetic oil having a kinematic viscosity ranging from 3 to 20 cSt at 100° C.

Japanese Patent Laid-Open No.62-275198 proposes a composition prepared by adding 3 to 10 percent by weight in total, of an organomolybdenum compound, organozinc compound and aryl phosphate, each being soluble in a base oil for lubricant, to said base oil, and a lubricant prepared by blending the composition in a weight ratio of 0.5 to 1.5 (organomolybdenum compound):0.5 to 1.5 (organozinc compound):0.5 to 1.5 (aryl phosphate).

Japanese Patent Laid-Open No.5-279688 teaches that friction characteristics can be improved without reducing wear resistance and other characteristics by blending an organomolybdenum compound, aliphatic ester, metal detergent (calcium or magnesium sulfonate, calcium or magnesium phenate), ashless detergent-dispersant (benzylamine, alkenylsucciniimide, boron derivative of alkylsucciniimide) and wear-proofing agent (zinc dithiophosphate, zinc dithiocarbamate).

Japanese Patent Laid-Open No.5-311186 teaches that the coefficient of friction of a lubricating oil can be drastically lowered by blending sulfurized oxymolybdenum dithiocarbamate and/or sulfurized oxymolybdenum organophosphorodithioate; an aliphatic ester and/or an organoamide compound in specific amount ratios with a combination system of a metal dithiocarbamate having not greater than 4 carbon atoms with an oil-soluble amine compound.

Problems the Invention Aims to Solve

However, although the composition of Japanese Patent Publication No.3-23595 has high initial performance, its performance drops with degradation of the oil. Thus, this prior art cannot solve the problems described above, and improvements are left yet to be made.

Japanese Patent Laid-Open No.62-275198 describes that MoDTC, ZnDTP and aryl phoaphate preferably exist specifically in a weight ratio of about 1:1:1, and that the total weight in the final lubricant (that is, the total of the three components) is particularly from 3.9 to 9.9%, more particularly 5.9 to 7.9% such as about 6.9%. In the composition described above, however, the amounts of addition of both MoDTC and ZnDTP are so great that the problems of friction resistance and wear resistance are left yet to be improved. As also described already, the reduction of the P content has been made vigorously in engine oils, and oils having a F content of higher than 1,200 ppm are not generally employed. For this reason, too, the composition described above cannot be used for engine oils.

Moreover, none of these patent applications study the behaviour of MoDTC with degradation of the oil, and it is doubtful whether the performance of MoDTC can be maintained at the time of oil degradation. Further, performance of residual MoDTC has become more important at the time of oil degradation with increases in the term of long drain.

Further, the compositions described in the above patent applications do not completely solve the various problems with engine oils described above. In other words, the use of MoDTC is essential at the present time from the aspects of lower viscosity engine oils or saving energy costs through friction regulating additives. Also, it is very important to find a composition which fully exploits the performance of MoDTC in order to solve the various problems due to drops in mechanical efficiency from friction, seizure and friction loss.

It is therefore an object of the present invention to provide an engine oil composition which fully exploits the performance of MoDTC, restricts the degradation of MoDTC itself, has a high residual MoDTC property even at the time of oil degradation, provides low friction and low wear for a long term and results in reduced fuel consumption, in order to solve the various problems with friction.

It is another object of the present invention to provide an engine oil composition which fully exploits the performance of MoDTC and has an excellent coefficient of friction and extreme-pressure properties under fluid lubricating conditions from extreme-pressure conditions.

Means of Solving the Problems

To accomplish the objects described above, the present inventors have conducted studies and have found out that the performance of MoDTC can be extended and that low friction as well as low wear can be achieved over long periods by combining MoDTC with ZnDTP having a primary alkyl group with 8 to 14 carbon atoms. Thus, a first embodiment of the present invention has been completed.

In other words, an engine oil composition according to the first embodiment of the present invention comprises, as the essential components:

(A) at least one kind of molybdenum dithiocarbamate (MoDTC) represented by the following general formula (1):

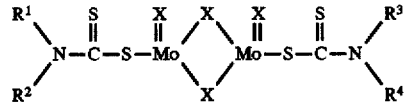

(1)

wherein each of $R^1$, $R^2$, $R^3$ and $R^4$ may be the same or different and each represent an alkyl group having 8 to 16 carbon atoms, X represents a sulfur atom or oxygen atom, and a ratio of the sulfur atoms to the oxygen atoms is from 1/3 to 3/1;

(B) at least one kind of neutral or basic zinc dithiophosphate (ZnDTP) represented by the following general formula (2) wherein the proportion of zinc dithiophosphate whose R, which may be the same or different and represents a primary alkyl group having 8 to 14 carbon atoms, is at least 50 percent by weight in all the zinc dithiophosphates:

$$Zn[(RO)_2PS_2]_2 \cdot aZnO \quad (2)$$

wherein a is 0 or 1/3 and R may be the same or different and represents an alkyl group having 3 to 14 carbon atoms: and (C) a base oil for engine oil;

wherein the proportion of the Component (A) is 0.03 to 1 parts by weight based on 100 parts by weight of base oil for the engine oil, and the proportion of the Component (B) is 0.01 to 2 parts by weight.

In the engine oil composition according to the present invention, it is particularly preferred that all R groups in the general formula (2) be 2-ethylhexyl groups.

Also, to accomplish another of the objects described above, the present inventors have conducted intensive studies and have found out that surprising lubricating performance can be obtained by combining MoDTC, ZnDTP and a certain kind of half ester of a particular fatty acid (in the present specification, a polyhydric alcohol in which part of the hydroxyl groups in said alcohol are esterified will be called a "half ester"). Thus, a second embodiment of the present invention has been completed.

In other words, the engine oil composition according to the second embodiment of the present invention is prepared by blending 0.1 to 5 parts by weight of at least one kind of polyglycerin half esters represented by the following general formula (3) to 100 parts by weight of a base oil for engine oil:

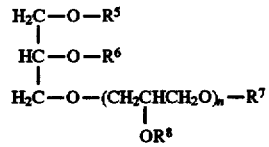

(3)

wherein n is an integer of $1 \leqq n \leqq 9$. $R^5$ to $R^8$ each represent hydrogen atoms or an acyl groups having 8 to 20 carbon atoms with the provision that all $R^5$ to $R^8$ are never simultaneously either all hydrogen atoms nor all acyl groups, and individual $R^8$'s may be the same or different when n is 2 or more.

When importance is attached to the extreme-pressure property of the engine oil composition in the second embodiment of the present invention, it is preferred that the polyglycerin half esters are at least one kind in which the number (Y) of the acyl groups in the general formula (3) is within the range of $1 \leqq Y \leqq (n+5)/2$ [polyglycerin half esters of this kind will hereinafter be called "polyglycerin half esters (I)"].

In the second embodiment of the present invention, it is further preferred that the polyglycerin half ester is at least one kind in which the proportion of lauryl groups and/or oleyl groups to all the acyl groups in the general formula (3) is at least 25% [polyglycerin half esters of this kind will hereinafter be called "polyglycerin half esters (II)"].

Further, in the second embodiment of the present invention, it is most preferred that the polyglycerin half esters are at least one kind in which the acyl groups in the general formula (3) are all oleyl groups and/or lauryl groups [polyglycerin half esters of this kind will hereinafter be called "polyglycerin half esters (III)].

Embodiments

In MoDTC represented by the general formula (1) as the Component (A) used in the present invention, the hydrocarbyl groups represented by $R^1$, $R^2$, $R^3$ and $R^4$ may contain saturated or unsaturated bonds and may be a straight chain type, a branched chain type or ring-like, or combinations thereof. Though they may contain 8 to 16 carbon atoms in some cases from the aspect of lubricating properties, they preferably contain 8 to 13 carbon atoms with 8 carbon atoms being particularly suitable.

Such hydrocarbyl groups are aliphatic groups, aromatic groups and aromatic-aliphatic groups. More concretely, they are alkyl groups such as an octyl group, 2-ethylhexyl group, nonyl group, decyl group, dodecyl group, lauryl group, tridecyl group, isotridecyl group, tetradecyl group, pentadecyl group, hexadecyl group, and so forth. Preferred among them are the 2-ethylhexyl group, octyl group, tridecyl group and isodecyl group, and further preferred are those in which $R^1$, $R^2$, $R^3$ and $R^4$ are a 2-ethylhexyl group.

Further, in MoDTC represented by the general formula (1), none of the X's are simultaneously O or S. In other words, the ratio S/O is within the range of 1/3 to 3/1. If all of the X's are oxygen, the lubricating property becomes inferior, and if all of the X's are sulfur, corrosion is more likely to develop.

(A) MoDTC represented by the general formula (1) is used in an amount of 0.03 to 1 part by weight, preferably 0.1 to 0.6 part by weight based on 100 parts by weight of the base oil for engine oil. If the amount is less than 0.03 parts by weight, the reduction of the coefficient of friction is not sufficient and if it exceeds 1 part by weight, a further effect of reducing the coefficient of friction cannot be obtained, and conversely adverse influences such as the occurrence of sludge tend to occur.

Such (A) MoDTC can be produced by the methods described, for example, in Japanese Patent Publication Nos.53-31646, 55-40593, 56-12638, 57-24797, 58-50233 and 62-81396.

In ZnDTP as the Component (B) represented by the general formula (2) used in the present invention, a is zero or 1/3. When a=zero, the component is generally called a "neutral salt" and when a=1/3, it is generally called a "basic salt". The (B) ZnDTP used in the present invention may be a neutral salt, a basic salt or combinations thereof.

In (B) ZnDTP represented by the general formula (2) used in the present invention, the hydrocarbyl group represented by R may contain saturated or unsaturated bonds having 3 to 14 carbon atoms, and may be a straight chain type, a branched chain type, a ring-type or combinations thereof. Further, the hydrocarbyl groups may be the same or different, but the proportion of ZnDTP in which all of the R groups are primary alkyl groups having 8 to 14 carbon atoms (they may be the same or different) in all the ZnDTPs must be at least 50 percent by weight.

Such hydrocarbyl groups include aliphatic types, aromatic types and aromatic-aliphatic types. Concrete examples include alkyl groups such as an octyl group, 2-ethylhexyl group, nonyl group, decyl group, lauryl group, tridecyl group, tetradecyl group, etc; cycroalkyl groups such as a cyclohexanethyl group, etc; and aryl groups such as an alkyl-substituted phenyl group (for example, phenylmethyl group, phenylethyl group and xylyl group). The hydrocarbyl groups are preferably a 2-ethylhexyl group, octyl group, nonyl group and tridecyl group and most preferably, all of the R groups are 2-ethylhexyl and octyl groups.

These (B) ZnDTPs may be used either individually or in combinations of two or more in mixture. Though they function as an extreme-pressure, agent, anti-oxidant, corrosion inhibitor, etc., the effect of the present invention cannot be obtained unless at least 50 percent by weight of ZnDTP having the primary alkyl group is added. The greater the content of ZnDTP whose primary alkyl groups are all 2-ethylhexyl groups or octyl groups, the higher the MoDTC residual effect becomes.

The (B) ZnDTP represented by the general formula (2) is used in the amount of 0.01 to 2 parts by weight based on 100 parts by weight of the base oil for engine oil. If the amount is less than 0.01 part by weight, the effect of improving the MoDTC (A) residual property is not sufficient and if it exceeds 2 parts by weight, the coefficient of friction at the time of degradation of the base oil or the engine oil deteriorates. If the amount added is great, the catalyst of an exhaust gas device is likely to be poisoned. Therefore, the (B) ZnDTP is preferably used in an amount not greater than 1.5 parts by weight.

The (C) base oil for engine oil used in the lubricating oil composition according to the present invention is not particularly limited, and known base oils for engine oil can be employed. At least one kind of natural oil or synthetic lubricating oil, or mixtures thereof can be used. Such oils preferably have a viscosity index (VI) of at least 100, more preferably at least 100, and most preferably at least 120.

Examples of such natural oils include animal oils, vegetable oils, oils obtained from petroleum, paraffin type oils, naphtene type oils, hydrocracked VHVI oils and mixtures thereof. Example of synthetic lubricating oils include olefinic polymers and copolymers such as polybutylene, polypropylene, propylene-isobutylene copolymers, polybutylene chloride, poly(1-hexene), poly(1-octene), poly1-decene), etc., polyphenyls such as dodecylbenzene, tetradecylbenzene, biphenyl, terphenyl, alkylphenyl, etc., alkyl diphenyl ethers, diphenyl alkylsulfate and derivatives thereof, and hydrocarbon oils such as analogs and homologs, and halogen-substituted hydrocarbons. Examples further include oils obtained by polymerizing ethylene oxide or propylene oxide, alkyl and aryl ethers of polyoxyalkylene polymers thereof, or mono- or polyvalent carboxylic acid esters or diesters thereof. Diesters obtained from phthalic acid, succinic acid, alkylsuccinic acid and dimers of alkylsuccinic acid, sebacic acid, adipic acid and linolic acid and various alcohols, and polyol esters prepared from polyhydric alcohols, can also be employed. Other :examples include silicic acid type oils such as polyalkylsiloxane oils, polyarylsiloxane oils, polyalkoxysiloxane oils and silicate oils such as polyaryloxysiloxane oils and silicate oils and liquid esters of phosphorus-containing acids such as TCP, TOP, diethylesters of decylsulfonic acid, etc. Preferred among them are hydrocracked VHVI oil and synthetic oils of polybutene. From the aspect of long drain, hydrocracked VHVI oils having high oxidation stability, mixtures of hydrocracked VHVI oil and poly-alpha-olefin and/or polyol esters and mixtures of poly-alpha-olefin and polyol esters are particularly preferred.

Further, the engine oil composition according to the first embodiment of the present invention is aimed at improving the MoDTC residual property at the time of oil degradation by combining (A) MoDTC and (B) ZnDTP containing at least 50 percent by weight of the primary alkyl group having 8 to 14 carbon atoms. When a higher MoDTC residual property is desired, however, an amine type or phenol type anti-oxidant, metal detergent, ashless dispersant, etc., are preferably used in combination.

In the antioxidants, examples of the amine type antioxidants include alkylated diphenylamine, phenyl-alpha-naphtylamine, alkylated-alpha-naphtylamine, etc, and examples of the phenol type antioxidants include 2,6-di-t-butylphenol, 4,4-methylene-bis-(2,6-ditertiarybutylphenol), etc. These antioxidants are generally used in a proportion of 0.05 to 2.0 percent by weight.

Examples of the metallic detergents include phanates, sulfonates, phosphorares, salicylates, etc., of barium (Ba), calcium (Ca) and magnesium (Mg), as well as perbasic detergents. These detergents are generally used in a proportion of 0.1 to 10 percent by weight.

Examples of the ashless detergent/dispersants include benzylamine, boron derivatives of benzylamine, alkenylsucciniimide, boron derivatives of alkenylsucciniimide, and so forth. These detergent/dispersants are generally used in a proportion of 0.5 to 15 percent by weight.

If it is desired that the MoDTC remain, the conjoint use of the hydrocracked VHVI oil is preferred.

Other known extreme-pressure agents, friction mitigators, wear-proofing agents, viscosity index improving agents, rust-proofing agents, fluidization point lowering agents, defoamants, corrosion inhibitors, etc., such as the wear mitigators, e.g., higher aliphatic acids, higher alcohols, amines, esters, etc, and the extreme-pressure agents, e.g., sulfur type, chlorine type, phosporus type, organometallic type, etc., may be used in combination in ordinary amounts of use, whenever desired, within the range of the object of the present invention.

Next, in the (D) polyglycerin half esters represented by the general formula (3) that are used in the engine oil composition according to the second invention of the present invention, each of $R^5$ to $R^8$ represents a hydrogen atom and/or an acyl group having 8 to 20 carbon atoms, but $R^5$ to $R^8$ are never simultaneously the hydrogen atom, nor are they simultaneously the acyl group. When n is at least 2, n•$R^{8'}$s exist and in this case, each of such $R^{8'}$s may be the hydrogen atom and/or the acyl group and may be the same or different. In this specification, a polyhydric alcohol in which part of the hydroxyl groups in said alcohol are esterified will be called a "half ester". The residue of the acyl group (that is, the residue obtained by removing the carbonyl group from the acyl group) may contain a saturated or unsaturated bond(s), and may be of a straight chain type, a branched chain type, a ring-like type or combinations thereof.

Examples of such acyl groups include straight chain saturated acyl groups such as a lauryl group, myristyl group, palmityl group, stearyl group, etc., branched chain saturated acyl groups such as a 2-ethylhexyl group, isononyl group, isotridecyl group, isostearyl group, etc., mono-saturated acyl groups such as a linderenyl group (4-dodecenyl group), tsuzuyl group (4-tetradecenyl group), physetoleyl group (5-tetradecenyl group), myristoleyl group (9-tetradecenyl group), zoomaryl group (9-hexadecenyl group) petroselyl group (6-octadecenyl group), oleyl group, eleidyl group, gadoleyl group (9-icocenyl group), gondoyl group, etc., poly-unsaturated acyl groups such as a linoleyl group (9, 12-octadecadienyl group), linoelaidyl group, linolenyl group (9, 12, 15-octadecatrienyl group), eleostearyl group (9, 12, 13-octadecatrienyl group), moroctyl group, parinaryl group (9, 11, 13, 15-octadecatetraenyl group), arachidonyl group (5, 8, 11, 14-icosatetraenyl group), etc., acetyleneacyl groups such as a stearolyl group (9-octadecynyl group), isanyl group, xymenyl group, etc., cyclic acyl groups such as a hydrocarpyl group, chaulmoogryl group, sterculyl group, etc., and branched chain acyl groups such as a tuberculostearyl group.

In the (D) polyglycerin half esters used for the engine oil composition according to the second invention of the present invention, the number (Y) of the acyl groups in the polyglycerin half esters (I), (II) or (III) is within the range of $1 \leqq Y \leqq (n+5)/2$ and preferably, within the range of $1 \leqq Y \leqq (n+3)/2$. Here, n corresponds to n in the general formula (3). When two or more kinds of half esters are used in combination as the polyglycerin half esters (I), (II) or (III), Y represents the mean number of the acyl groups in these two or more kinds of polyglycerin half esters. The polyglycerin half esters having Y falling within the range described above are most preferred because the proportion of the hydroxyl groups and the acyl groups exhibits the extreme-pressure property. Therefore, where this extreme-pressure property is particularly required, it is advisable to use an engine oil composition containing the polyglycerin half esters (I), (II) or (III) as the essential components.

Further, in the (D) polyglycerin half esters used for the engine oil composition according to the second embodiment of the present invention, the proportion of the lauryl groups and/or the oleyl groups in the total acyl groups is at least 25% in the polyglycerin half esters (II) or (III). In connection with the acyl groups in the polyglycerin half esters, the melting point becomes lower as the degree of unsaturation increases but stability drops, and though the lubrication property becomes better with a greater number of carbon atoms, the crystal precipitates at a low temperature. For these reason, the lauryl group and the oleyl group are preferred. Where a higher extreme-pressure is required than in the case described above, it is preferred to use an engine oil composition comprising the polyglycerin half esters (II) or (III) as the essential constituent components.

In the (D) polyglycerin half esters used for the engine oil composition according to the second invention of the present invention, the acyl groups of the polyglycerin half esters (III) are all oleyl groups and/or lauryl groups. When the polyglycerin half esters are used as the extreme-pressure agent, the oleyl group or the lauryl group is most preferred for the reasons described above. Accordingly, when a greater extreme-pressure polarity is required over the case described above, it is preferred to use an engine oil composition containing the polyglycerin half eaters (III) as the essential constituent components.

In the (D) polyglycerin half esters used for the engine oil composition according to the second embodiment of the present invention, the amount added of the polyglycerin half esters (I), (II) and (III) is from 0.1 to 5 parts by weight based on 100 parts by weight of the base oil for engine oil as the Component (C). Further, it is possible to use, in combination, at least two kinds of those polyglycerin half esters (I), (II) or (III) whose $R^5$ to $R^8$ and whose n are different. As to the amount of use in this case, the total amount of the plurality of polyglycerin half esters (I), (II) or (III) used must be within the range described above.

It has been clarified that these (D) polyglycerin half esters have excellent extreme-pressure properties and when they are blended with (A) MoDTC and (B) ZnDTP in a predetermined molar ratio, they exhibit a surprisingly high lubrication property. Concrete examples include diglycerin monolaurate, diglycerin dilaurate, diglycerin trilaurate, diglycerin monooleate, diglycerin dioleate, diglycerin trioleate, diglycerin monolauryl monooleate, diglycerin monolauryl dioleate, diglycerin dilauryl monooleate, tetraglycerin monooleate, tetraglycerin monolaurate, tetraglycerin monooleyl. monostearate, tetraglycerin monolauryl monostearate, hexaglycerin monooleate, hexaglycerin monolaurate, hexaglycerin pentaoleate, hexaglycerin dioleyl distearate, hexaglycerin dioleyl pentastearate, hexaglycerin dilauryl pentastearate, decaglycerin monooleate, decaglycerin monolaurate, decaglycerin pentaolely pentastearate, decaglycerin pentalauryl pentastearate, and so forth. Preferred among them are diglycerin monooleate, diglycerin dioleate, diglycerin tetraoleate, tetraglycerin monooleate, tetraglycerin monolaurate, hexaglycerin monooleate, hexaglycerin monolaurate, hexaglycerin pentaoleate, decaglycerin monooleate, decaglycerin monolaurate, etc.

In an anther aspect of the engine oil composition according to the second embodiment of the present invention, the amounts added of the (A) MoDTC, (B) ZnDTP and (D) polyglycerin half esters [polyglycerin half ester, polyglycerin half esters (I) or polyglycerin half esters (II)] based on parts by weight of (C) base oil for engine oil are as follows:

| | |
|---|---|
| (A) MoDTC | 0.03 to 1 part by weight |
| (B) ZnDTP | 0.01 to 2 parts by weight |
| (D) polyglycerin half esters | 0.1 to 5 parts by weight |

If the amount of each component added is too low, no effects appear and if too great, no effects exceeding a predetermined level appear and on the contrary, the lubrication property might be adversely affected. To obtain excellent lubrication properties, therefore, these amounts must be essentially satisfied.

Further, when either of the polyglycerin half esters (II) or (III) is used as the polyglycerin half ester in the engine oil composition according to the second invention of the present invention, the amounts added of (A) MoDTC, (B) ZnDTP and (D) polyglycerin half ester (II) or (III) are as follows:

| | |
|---|---|
| (A) MoDTC | 0.03 to 1 part by weight |
| (B) ZnDTP | 0.01 to 2 parts by weight |
| (D) polyglycerin half ester | 0.1 to 5 parts by weight |

total amount of (A)+(B)+(C)=1 to 7 parts by weight; proportion of (A):(B):(C)=0.1 to 1.5:1:1 to 10.

Blending of these components is preferably made so as to satisfy the relations described above. Higher lubrication performance can be obtained by using them within this range because these additives for the lubricating oil provide a preferable interaction within this range. Accordingly, when the extreme-pressure property is particularly required, this engine oil composition is preferably used.

Further, various known extreme-pressure agents, friction mitigators, wear-proofing agents, etc., such as the friction mitigators typified by higher fatty acids, higher alcohols, amines, esters, etc., and the extreme-pressure agents typified by sulfur types, chlorine types, phosphorus types, organometallic types, etc., may be used in combination in ordinary amounts of use within the range of the object of the present invention.

Various known additives such as antioxidants typified by phenols and amines, detergents typified by neutral or high basic alkaline earth metal sulfonates, phenates, carboxylates, etc., dispersants such as succiniimide, benzylamines, etc., viscosity index improving agents such as high molecular weight polymethacrylates, polyisobutylene, polystyrene, ethylene-propylene copolymers, styrene-isobutylene copolymers, etc., defoamants such as esters and silicones, and other rust preventives, fluidization point lowering agents, etc., may be suitably added in ordinary amounts of use within the object of the present invention, if necessary.

EXAMPLES

Hereinafter, the present invention will be explained in further detail with reference to Examples thereof, but the invention is not particularly limited thereto.

Example A

The engine oil composition according to the first invention of the present invention was prepared by using each of the following Samples 1 to 17 in the blend proportions described in Table 1, and was subjected to various tests.

Sample 1: Compound represented by the following formula [(A) MoDTC]:

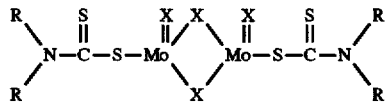

(wherein R is a 2-ethylhexyl group, and S/O=2.2)

Sample 2: Compound represented by the following formula [(A) MoDTC]:

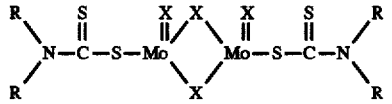

(wherein R is an isotridecyl group, and S/O=1.5)

Sample 3: Compound represented by the following formula [(A) MoDTC]:

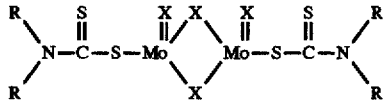

(wherein R is an isotridecyl group and 2-ethylhexyl group, and S/O=2.2 in a molar ratio)

Sample 4: Compound represented by the following formula [(B) ZnDTP]:

$$Zn[(RO)_2PS_2]_2 \cdot aZnO$$

(wherein R is a primary 2-ethylhexyl group, and a weight ratio of a neutral salt (a=0):basic salt (a=1/3)=55:45)

Sample 5: Compound represented by the following formula [(B) ZnDTP]:

$$Zn[(RO)_2PS_2]_2 \cdot aZnO$$

(wherein R is a primary octyl group, and a weight ratio of a neutral salt:basic salt=68:32)

Sample 6: Compound represented by the following formula [(B) ZnDTP]:

$$Zn[(RO)_2PS_2]_2 \cdot aZnO$$

(wherein R is a primary dodecyl group, and a weight ratio of neutral salt:basic salt=62: 38)

Sample 7: Compound represented by the following formula [(B) ZnDTP]:

$$Zn[(RO)_2PS_2]_2 \cdot aZnO$$

(wherein R is a primary tridecyl group, and a weight ratio of neutral salt:basic salt=85:15)

Sample 8: Compound represented by the following formula [(B) ZnDTP]:

$$Zn[(RO)_2PS_2]_2 \cdot aZnO$$

(wherein R is a primary tetradecyl group, and a weight ratio of neutral salt:basic salt=86:14)

Sample 9: Compound represented by the following formula [(B) ZnDTP]:

$$Zn[(RO)_2PS_2]_2 \cdot aZnO$$

(wherein R is a primary hexyl group, and a weight ratio of neutral salt:basic salt=52:48)

Sample 10: Compound represented by the following formula [(B) ZnDTP]:

$$Zn[(RO)_2PS_2]_2 \cdot aZnO$$

(wherein R is a secondary propyl group or n-hexyl group, and a weight ratio of neutral salt:basic salt=97:3)

Sample 11: Compound represented by the following formula [(B) ZnDTP]:

$$Zn[(RO)_2PS_2]_2 \cdot aZnO$$

(wherein R is a secondary hexyl group, and a weight ratio of neutral salt:basic salt=97:3)

Sample 12: Phenyl-alpha-naphthylamine

Sample 13: Boric acid derivative of alkenylsucciniimide

Sample 14: [(C) base oil for engine oil]

100 neutral oil (19.9 cSt at 100° C., VI=105)

Sample 15: [(C) base oil for engine oil]

Hydrocracked VHVI oil (18.6 cSt at 100° C., VI=105)

Sample 16: Compound represented by the following formula (MoDTC):

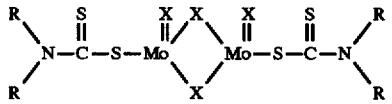

(wherein R is an isotridecyl group or 2-ethylhexyl group, and X=O)

Sample 17: Compound represented by the following formula (MoDTC):

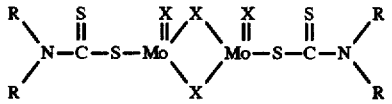

(wherein R is an isotridecyl group or 2-ethylhexyl group, and X=S)

TABLE 1

| | Blending ratio of the engine oil compositions (amount added based on 100 parts by weight of base oil for engine oil) | | | | |
|---|---|---|---|---|---|
| | (A) MoDTC | | (B) ZnDTP | | (C) Base Oil for |
| | Sample No. | Amount Added Parts by Weight | Sample No. | Amount Added Parts by Weight | Engine Oil Sample No. |
| Example 1 | 1 | 0.4 | 4 | 0.94 | 15 |
| Example 2 | 1 | 0.4 | 5 | 0.94 | 15 |
| Example 3 | 1 | 0.4 | 6 | 0.94 | 15 |
| Example 4 | 1 | 0.4 | 7 | 0.94 | 15 |
| Example 5 | 1 | 0.4 | 8 | 0.94 | 15 |
| Example 6 | 2 | 0.4 | 4 | 0.94 | 15 |
| Example 7 | 2 | 0.4 | 5 | 0.94 | 15 |
| Example 8 | 2 | 0.4 | 6 | 0.94 | 15 |
| Example 9 | 2 | 0.4 | 7 | 0.94 | 15 |
| Example 10 | 2 | 0.4 | 8 | 0.94 | 15 |
| Example 11 | 3 | 0.4 | 4 | 0.94 | 15 |
| Example 12 | 3 | 0.4 | 5 | 0.94 | 15 |
| Example 13 | 3 | 0.4 | 6 | 0.94 | 15 |
| Example 14 | 3 | 0.4 | 7 | 0.94 | 15 |
| Example 15 | 3 | 0.4 | 8 | 0.94 | 15 |
| Example 16 | 1 | 0.1 | 4 | 0.94 | 15 |
| Example 17 | 1 | 0.55 | 4 | 0.94 | 15 |
| Example 18 | 1 | 0.7 | 4 | 0.94 | 15 |
| Example 19 | 1 | 0.4 | 4 | 0.6 | 15 |
| Example 20 | 1 | 0.4 | 4 | 1.1 | 15 |
| Example 21 | 1 | 0.4 | 4 | 1.3 | 15 |

TABLE 1-continued

| | Blending ratio of the engine oil compositions (amount added based on 100 parts by weight of base oil for engine oil) | | | | |
|---|---|---|---|---|---|
| | (A) MoDTC | | (B) ZnDTP | | (C) Base Oil for |
| | Sample No. | Amount Added Parts by Weight | Sample No. | Amount Added Parts by Weight | Engine Oil Sample No. |
| Example 22 | 1 | 0.4 | 4 | 0.94 | 16 |
| Example 23 | 2 | 0.1 | 4 | 0.94 | 15 |
| Example 24 | 2 | 0.7 | 4 | 0.94 | 15 |
| Example 25 | 2 | 0.4 | 4 | 0.6 | 15 |
| Example 26 | 2 | 0.4 | 4 | 1.1 | 15 |
| Example 27 | 2 | 0.4 | 4 | 1.3 | 15 |
| Example 28 | 2 | 0.4 | 4 | 0.94 | 16 |
| Example 29 | 3 | 0.2 | 4 | 0.94 | 15 |
| Example 30 | 3 | 0.55 | 4 | 0.94 | 15 |
| Example 31 | 3 | 0.8 | 4 | 0.94 | 15 |
| Example 32 | 3 | 0.4 | 4 | 0.6 | 15 |
| Example 33 | 3 | 0.4 | 4 | 1.2 | 15 |
| Example 34 | 3 | 0.4 | 4 | 0.94 | 16 |
| Example 35 | 1 | 0.4 | 4 | 0.75 | 15 |
| | | | 10 | 0.19 | |
| Example 36 | 1 | 0.4 | 4 | 0.56 | 15 |
| | | | 10 | 0.38 | |
| Example 37 | 1 | 0.4 | 4 | 0.75 | 15 |
| | | | 11 | 0.19 | |
| Example 38 | 1 | 0.4 | 4 | 0.56 | 15 |
| | | | 11 | 0.38 | |
| Example 39 | 1 | 0.05 | 4 | 0.66 | 15 |
| | | | 5 | 0.28 | |
| Example 40 | 1 | 0.4 | 7 | 0.75 | 15 |
| | | | 11 | 0.19 | |
| Example 41 | 1 | 0.05 | 4 | 0.94 | 15 |
| Example 42 | 1 | 0.9 | 4 | 0.94 | 15 |
| Example 43 | 1 | 0.4 | 4 | 0.1 | 15 |
| Example 44 | 1 | 0.4 | 4 | 1.9 | 15 |
| Example 45 | 1 | 0.2 | 4 | 0.94 | 15 |
| | 3 | 0.2 | | | |
| Example 46 | 1 | 0.2 | 4 | 0.75 | 15 |
| | 3 | 0.2 | 10 | 0.19 | |
| Comp. Example 1 | 1 | 0.4 | 10 | 0.94 | 15 |
| Comp. Example 2 | 1 | 0.4 | 11 | 0.94 | 15 |
| Comp. Example 3 | 1 | 0.4 | 4 | 0.28 | 15 |
| | | | 10 | 0.66 | |
| Comp. Example 4 | 1 | 0.4 | 4 | 0.56 | 15 |
| | | | 11 | 0.38 | |
| Comp. Example 5 | 1 | 0.4 | | | 15 |
| Comp. Example 6 | | | 4 | 0.94 | 15 |
| Comp. Example 7 | 1 | 0.01 | 4 | 0.94 | 15 |
| Comp. Example 8 | 1 | 0.4 | 4 | 0.005 | 15 |
| Comp. Example 9 | 1 | 2.3 | 4 | 0.94 | 15 |
| Comp. Example 10 | 1 | 0.4 | 4 | 3.0 | 15 |
| Comp. Example 11 | 1 | 0.4 | 9 | 0.94 | 15 |

An engine oil oxidation stability test (ISOT test) was carried out by the following method for each of the engine oil compositions obtained above, and measurement of the amount of sludge, measurement of the residual MoDTC amount by high speed liquid chromatography and measurement of the coefficient of friction by an SRV tester were carried out for the oil after the test. The results are summarized in Table 2.

<Engine Oil Oxidation Stability Test>

The engine oil oxidation stability test was conducted in accordance with JIS K2514 under the following conditions:

| Condition: | |
|---|---|
| temperature | 165.5° C. |
| speed | 1,300 rpm/min |
| test time | 48 hours |

<Test Measuring Coefficient of Friction>

The test measuring the coefficient of friction was conducted by using an SRV tester under the following conditions:

| Condition: | |
|---|---|
| Line contact: | The test was conducted under a cylinder-on-plate line contact condition. An upper cylinder (ϕ15 × 22 mm) was perpendicularly set to a plate (ϕ24 × 7.85 mm) in a sliding direction and was allowed to reciprocate so as to measure the coefficient of friction. The material of said cylinder and plate was SUJ-2. |
| load: | 200N |
| temperature: | 80° C. |
| measurement time: | 15 minutes |
| amplitude: | 1 mm |
| cycle: | 50 Hz |

TABLE 2

Lubricating test results of the engine oil compositions

| | Coefficient of Friction New Oil | Degraded Oil | Residual MoDTC (Mo Content of New Oil as 100%) | Amount of Sludge |
|---|---|---|---|---|
| Example 1 | 0.065 | 0.045 | 67 | not greater than 0.08 g |
| Example 2 | 0.065 | 0.05 | 65 | not greater than 0.08 g |
| Example 3 | 0.065 | 0.055 | 64 | not greater than 0.08 g |
| Example 4 | 0.06 | 0.055 | 65 | not greater than 0.08 g |
| Example 5 | 0.065 | 0.055 | 63 | not greater than 0.08 g |
| Example 6 | 0.06 | 0.05 | 64 | not greater than 0.08 g |
| Example 7 | 0.06 | 0.05 | 62 | not greater than 0.08 g |
| Example 8 | 0.06 | 0.05 | 62 | not greater than 0.08 g |
| Example 9 | 0.065 | 0.06 | 63 | not greater than 0.08 g |
| Example 10 | 0.06 | 0.055 | 61 | not greater than 0.08 g |
| Example 11 | 0.06 | 0.04 | 70 | not greater than 0.08 g |
| Example 12 | 0.065 | 0.05 | 68 | not greater than 0.08 g |
| Example 13 | 0.065 | 0.055 | 67 | not greater than 0.08 g |
| Example 14 | 0.06 | 0.055 | 69 | not greater than 0.08 g |
| Example 15 | 0.065 | 0.055 | 67 | not greater than 0.08 g |
| Example 16 | 0.075 | 0.075 | 57 | not greater than 0.08 g |
| Example 17 | 0.065 | 0.045 | 67 | not greater than 0.08 g |
| Example 18 | 0.065 | 0.045 | 67 | 0.1 g |
| Example 19 | 0.065 | 0.055 | 55 | not greater than 0.08 g |
| Example 20 | 0.065 | 0.045 | 66 | not greater than 0.08 g |
| Example 21 | 0.065 | 0.05 | 67 | not greater than 0.08 g |
| Example 22 | 0.065 | 0.04 | 71 | not greater than 0.08 g |
| Example 23 | 0.075 | 0.075 | 57 | not greater than 0.08 g |
| Example 24 | 0.06 | 0.05 | 64 | 0.1 g |
| Example 25 | 0.065 | 0.06 | 47 | not greater than 0.08 g |
| Example 26 | 0.06 | 0.055 | 64 | not greater than 0.08 g |
| Example 27 | 0.065 | 0.055 | 64 | 0.1 g |
| Example 28 | 0.06 | 0.045 | 69 | not greater than 0.08 g |
| Example 29 | 0.07 | 0.07 | 65 | not greater than 0.08 g |
| Example 30 | 0.06 | 0.04 | 70 | not greater than 0.08 g |
| Example 31 | 0.06 | 0.04 | 70 | 0.1 g |
| Example 32 | 0.06 | 0.05 | 57 | not greater than 0.08 g |
| Example 33 | 0.06 | 0.045 | 70 | 0.1 g |
| Example 34 | 0.055 | 0.035 | 73 | not greater than 0.08 g |
| Example 35 | 0.063 | 0.06 | 65 | 0.15 g |
| Example 36 | 0.065 | 0.055 | 60 | 0.18 g |
| Example 37 | 0.065 | 0.05 | 65 | 0.15 g |
| Example 38 | 0.065 | 0.05 | 57 | 0.18 g |
| Example 39 | 0.065 | 0.045 | 66 | 0.15 g |
| Example 40 | 0.06 | 0.055 | 64 | not greater than 0.08 g |
| Example 41 | 0.075 | 0.08 | 50 | not greater than 0.08 g |
| Example 42 | 0.06 | 0.045 | 67 | 0.1 g |
| Example 43 | 0.06 | 0.07 | 42 | not greater than 0.08 g |
| Example 44 | 0.065 | 0.055 | 65 | 0.1 g |
| Example 45 | 0.065 | 0.04 | 67 | not greater than 0.08 g |
| Example 46 | 0.065 | 0.05 | 65 | 0.15 g |
| Comp. Example 1 | 0.06 | 0.09 | 10 | 0.3 g |
| Comp. Example 2 | 0.06 | 0.09 | 9 | 0.3 g |
| Comp. Example 3 | 0.063 | 0.135 | 0 | 0.25 g |
| Comp. Example 4 | 0.06 | 0.135 | 0 | 0.2 g |
| Comp. Example 5 | 0.055 | 0.133 | 29 | not greater than 0.08 g |
| Comp. Example 6 | 0.13 | 0.135 | 0 | not greater than 0.08 g |
| Comp. Example 7 | 0.1 | 0.135 | 0 | not greater than 0.08 g |
| Comp. Example 8 | 0.06 | 0.135 | 32 | not greater than 0.08 g |
| Comp. Example 9 | 0.065 | 0.045 | 67 | 0.3 g |

TABLE 2-continued

Lubricating test results of the engine oil compositions

| | Coefficient of Friction New Oil | Degraded Oil | Residual MoDTC (Mo Content of New Oil as 100%) | Amount of Sludge |
|---|---|---|---|---|
| Comp. Example 10 | 0.065 | 0.115 | 67 | 0.3 g |
| Comp. Example 11 | 0.065 | 0.09 | 14 | 0.1 g |

An antioxidant (Sample 13) and detergent (Sample 14) were added in amounts of 2.0 parts by weight, respectively, to 100 parts by weight of the base oil for the engine oil compositions similar to those of Examples 1, 6 and 11 (Examples 1', 6' and 11'), and similar tests were conducted for each of these engine oil compositions. The results are summarized in Table 3.

TABLE 3

Amounts added to 100 parts by weight and test results

| | Coefficient of Friction New Oil | Degraded Oil | Residual MoDTC (%) (Mo amount of new oil as 100%) | Sludge Amount |
|---|---|---|---|---|
| Example 1' | 0.065 | 0.04 | 70 | not greater than 0.08 g |
| Example 6' | 0.065 | 0.045 | 67 | not greater than 0.08 g |
| Example 11' | 0.065 | 0.050 | 73 | not greater than 0.08 g |

<Copper Plate Corrosion Test and Test Measuring Coefficient of Friction>

To conduct the copper plate corrosion test, to 100 parts by weight of Sample 14, 0.4 parts by weight of each of Samples 1, 2, 3, 16 and 17, and 0.04 parts by weight of Sample 4 were dissolved, respectively, and a copper plate was immersed and heated at 100° C. for 3 hours to test the corrosion property to the copper plate (in accordance with ASTM D 130).

The test measuring the coefficient of friction was carried out in the same way as above. The results are summarized in Table 4.

TABLE 4

| | Sample | Degree of Copper Plate Discoloration | Coefficient of Friction |
|---|---|---|---|
| Example 47 | 1 | 1a | 0.06 |
| Example 48 | 2 | 1a | 0.06 |
| Example 49 | 3 | 1a | 0.06 |
| Comp. Example 12 | 16 | 1a | 0.10 |
| Comp. Example 13 | 17 | 3b | 0.06 |

Example B

The engine oil composition according to the second invention of the present invention was prepared by using the same sample as the one used for Example A with the exception of the Samples described below, in the blending proportion summarized in Table 6, and various tests were conducted.

Sample 18: Compound represented by the following formula [(B) ZnDTP]:

$$Zn[(RO)_2PS_2]_2 \bullet aZnO$$

(wherein R is a primary dodecyl group, and a weight ratio of neutral salt:basic salt=62:38)

Sample 19: Compound represented by the following formula [(B) ZnDTF]:

$$Zn[(RO)_2PS_2]_2 \bullet aZnO$$

(wherein R is a secondary hexyl group and isopropyl group its ratio is 1/1, and a weight ratio of neutral salt:basic salt=60:40)

Sample 20 to 35: (D) polyglycerin half esters

TABLE 5

| Sample | Sample Name | In general formula (3) $R^5$ to $R^8$ x | Number of H | Number of acyl group | |
|---|---|---|---|---|---|
| 20 | Diglycerin monooleate | 1 | 3 | oleyl group | 1 |
| 21 | Hexaglycerin monooleate | 5 | 7 | oleyl group | 1 |
| 22 | Hexaglycerin trioleate | 5 | 5 | oleyl group | 3 |
| 23 | Hexaglycerin dioleate | 5 | 6 | oleyl group | 2 |
| 24 | Hexaglycerin monolaurate | 5 | 7 | lauryl group | 1 |
| 25 | Triglycerin dioleate | 2 | 3 | oleyl group | 2 |
| 26 | Diglycerin dioleate | 1 | 2 | oleyl group | 2 |
| 27 | Decaglycerin monooleate | 9 | 11 | oleyl group | 1 |
| 28 | Hexaglycerin pentaoleate | 5 | 3 | oleyl group | 5 |
| 29 | Decaglycerin monolaurate | 9 | 11 | lauryl group | 1 |
| 30 | Tetraglycerin monooleate | 3 | 5 | oleyl group | 1 |
| 31 | Diglycerin tetraoleate | 1 | 0 | oleyl group | 4 |
| 32 | Diglycerin monooleate | 0 | | oleyl group | 1 |
| 33 | Glycerin dioleate | 0 | | oleyl group | 2 |
| 34 | Sorbitan monooleate | — | | oleyl group | 1 |
| 35 | Sorbitan dioleate | — | | oleyl group | 2 |

Sample 36: (C) Base oil for engine oil

The base oil for engine oil used was prepared by adding 4 percent by weight of polymethacrylate as a viscosity index improving agent to a 150 neutral oil (5.1 cSt at 100° C.).

The amounts of addition of (A), (B) and (D) shown in Tables 6-1 and 6-2 represent the amounts (parts by weight) based on 100 parts by weight of the base oil for engine oil.

TABLE 6

| | | (A) MoDTC | | (B) ZnDTP | | (D) | | | |
|---|---|---|---|---|---|---|---|---|---|
| | | Sample | Amount Added | Sample | Amount Added | Sample | Amount Added | (A):(B):(D) Weight Ratio | Total Amount |
| Example 47 | | 1 | 0.4 | 4 | 0.9 | 20 | 1.0 | 0.4:1:1.1 | 2.3 |
| Example 48 | | 1 | 0.4 | 4 | 0.9 | 21 | 1.0 | 0.4:1:1.1 | 2.3 |
| Example 49 | | 1 | 0.4 | 4 | 0.9 | 22 | 1.0 | 0.4:1:1.1 | 2.3 |
| Example 50 | | 1 | 0.4 | 4 | 0.9 | 23 | 1.0 | 0.4:1:1.1 | 2.3 |
| Example 51 | | 1 | 0.4 | 4 | 0.9 | 24 | 1.0 | 0.4:1:1.1 | 2.3 |
| Example 52 | | 1 | 0.4 | 4 | 0.9 | 25 | 1.0 | 0.4:1:1.1 | 2.3 |
| Example 53 | | 1 | 0.4 | 4 | 0.9 | 26 | 1.0 | 0.4:1:1.1 | 2.3 |
| Example 54 | | 1 | 0.4 | 4 | 0.9 | 27 | 1.0 | 0.4:1:1.1 | 2.3 |
| Example 55 | | 1 | 0.4 | 4 | 0.9 | 28 | 1.0 | 0.4:1:1.1 | 2.3 |
| Example 56 | | 1 | 0.4 | 4 | 0.9 | 29 | 1.0 | 0.4:1:1.1 | 2.3 |
| Example 57 | | 1 | 0.4 | 4 | 0.9 | 30 | 1.0 | 0.4:1:1.1 | 2.3 |
| Example 58 | | 2 | 0.4 | 4 | 0.9 | 26 | 1.0 | 0.4:1:1.1 | 2.3 |
| Example 59 | | 3 | 0.4 | 4 | 0.9 | 26 | 1.0 | 0.4:1:1.1 | 2.3 |
| Example 60 | | 2 | 0.4 | 18 | 0.9 | 26 | 1.0 | 0.4:1:1.1 | 2.3 |
| Example 61 | | 3 | 0.4 | 19 | 0.9 | 26 | 3.0 | 0.4:1:3.3 | 3.3 |
| Example 62 | | 1 | 0.1 | 18 | 0.9 | 26 | 1.0 | 0.1:1:1.1 | 2.0 |
| Example 63 | | 3 | 0.9 | 19 | 0.9 | 26 | 1.0 | 1:1:1.1 | 2.8 |
| Example 64 | | 1 | 0.4 | 4 | 1.9 | 26 | 2.1 | 0.2:1:1.1 | 4.4 |
| Example 65 | | 1 | 0.4 | 4 | 0.2 | 26 | 1.8 | 2:1:9 | 2.3 |
| Example 66 | | 1 | 0.4 | 4 | 0.9 | 25 | 0.5 | | |
| | | | | | | 26 | 0.5 | 0.4:1:1.1 | 2.3 |
| Example 67 | | 2 | 0.45 | 18 | 0.3 | 26 | 0.3 | 1.5:1:1 | 1.05 |
| Example 68 | | 3 | 0.4 | 4 | 0.9 | 26 | 4.5 | 0.4:1:5 | 5.8 |
| Example 69 | | 1 | 0.4 | 19 | 0.9 | 26 | 1.0 | 0.4:1:1.1 | 2.3 |
| Example 70 | | 1 | 0.4 | 19 | 0.9 | 27 | 1.0 | 0.4:1:1.1 | 2.3 |
| Example 71 | | 1 | 0.4 | 19 | 0.9 | 24 | 1.0 | 0.4:1:1.1 | 2.3 |
| COMP. | 12 | | | 4 | 0.9 | 26 | 1.0 | —:1:1.1 | 1.9 |
| | 13 | 1 | 0.4 | | | 20 | 1.0 | 0.4:—:1.1 | 1.2 |
| | 14 | 1 | 0.4 | 4 | 0.9 | | | 0.4:1:— | 1.3 |
| | 15 | 1 | 0.005 | 4 | 0.9 | 21 | 1.0 | 0.005:1:1.1 | 1.905 |
| | 16 | 1 | 0.4 | 4 | 0.9 | 26 | 0.05 | 0.5:1:0.08 | 1.35 |
| | 17 | 1 | 0.4 | 4 | 0.9 | 31 | 0.1 | 0.5:1:0.16 | 1.4 |
| | 18 | 1 | 0.4 | 4 | 0.9 | 32 | 1.0 | 0.4:1:1.1 | 2.3 |
| | 19 | 1 | 0.4 | 4 | 0.9 | 33 | 1.0 | 0.4:1:1.1 | 2.3 |
| | 20 | 1 | 0.4 | 19 | 0.9 | 34 | 1.0 | 0.4:1:1.1 | 2.3 |
| | 21 | 1 | 0.4 | 19 | 0.9 | 32 | 0.5 | | |
| | | | | | | 33 | 0.5 | 0.4:1:1.1 | 2.3 |
| | 22 | 1 | 0.4 | 19 | 0.9 | 34 | 0.5 | | |
| | | | | | | 35 | 0.5 | 0.4:1:1.1 | 2.3 |
| | 23 | 1 | 0.4 | 19 | 0.9 | 35 | 1.0 | 0.4:1:1.1 | 2.3 |
| | 24 | 1 | 0.4 | 4 | 0.9 | 31 | 1.0 | 0.4:1:1.1 | 2.3 |
| | 25 | 1 | 0.4 | 4 | 0.9 | 26 | 8.0 | 0.4:1:8.9 | 9.3 |
| | 26 | 1 | 0.1 | 18 | 0.9 | 26 | 6.0 | 0.1:1:6.7 | 7.0 |

The seizure test and the measurements of the coefficient of friction were carried out on the engine oil compositions as the products of the present invention and as Comparative Examples, each having the blending ratios shown in Tables 6-1 and 6-2. The results are summarized in Table 7.

<Seizure Test>

The seizure test was conducted by using a Falex tester in accordance with ASTM D 3233. The initial oil temperature was 25° C. and a conditioning operation was carried out at 250 lb×5 minutes.

<Measurement of Coefficient of Friction>

The measurement of the coefficient of friction was conducted under the following conditions by using a pendulum tester.

| Conditions: | |
|---|---|
| oil temperature: | 80° C. |
| number measurements: | 50 times |

The coefficient of friction was a mean value of 50 measurements.

TABLE 7

| | Lubricating test result | |
|---|---|---|
| | Farex Test: Seizure Load | Pendulum Test: Coefficient of Friction |
| Example 47 | 1800 lb | 0.092 |
| Example 48 | 1750 lb | 0.093 |
| Example 49 | 1750 lb | 0.091 |
| Example 50 | 1800 lb | 0.092 |
| Example 51 | 1750 lb | 0.093 |
| Example 52 | 1800 lb | 0.091 |
| Example 53 | 1850 lb | 0.091 |
| Example 54 | 1750 lb | 0.093 |
| Example 55 | 1750 lb | 0.093 |
| Example 56 | 1750 lb | 0.093 |
| Example 57 | 1750 lb | 0.093 |
| Example 58 | 1850 lb | 0.090 |
| Example 59 | 1850 lb | 0.091 |
| Example 60 | 1850 lb | 0.090 |
| Example 61 | 1800 lb | 0.092 |
| Example 62 | 1700 lb | 0.095 |
| Example 63 | 1900 lb | 0.089 |
| Example 64 | 1750 lb | 0.092 |
| Example 65 | 1750 lb | 0.092 |

TABLE 7-continued

| Lubricating test result | | |
|---|---|---|
| | Farex Test: Seizure Load | Pendulum Test: Coefficient of Friction |
| Example 66 | 1800 lb | 0.092 |
| Example 67 | 1800 lb | 0.093 |
| Example 68 | 1800 lb | 0.092 |
| Example 69 | 1850 lb | 0.092 |
| Example 70 | 1750 lb | 0.093 |
| Example 71 | 1750 lb | 0.093 |
| Comp. Example 12 | 1050 lb | 0.285 |
| Comp. Example 13 | 1350 lb | 0.230 |
| Comp. Example 14 | 1400 lb | 0.230 |
| Comp. Example 15 | 1350 lb | 0.280 |
| Comp. Example 16 | 1050 lb | 0.230 |
| Comp. Example 17 | 1400 lb | 0.240 |
| Comp. Example 18 | 1400 lb | 0.230 |
| Comp. Example 19 | 1450 lb | 0.210 |
| Comp. Example 20 | 1450 lb | 0.200 |
| Comp. Example 21 | 1450 lb | 0.180 |
| Comp. Example 22 | 1450 lb | 0.180 |
| Comp. Example 23 | 1400 lb | 0.210 |
| Comp. Example 24 | 1450 lb | 0.230 |
| Comp. Example 25 | 1450 lb | 0.250 |
| Comp. Example 26 | 1450 lb | 0.230 |

Further, oxidation stability tests were conducted for the engine oil compositions of Examples 47 to 49 and Comparative Examples 12 and 16 by the following method. The results are summarized in Table 8.

<Oxidation Stability Test>

The oxidation stability test was carried out in accordance with JIS K 2514. After each sample oil was degraded by setting the temperature of a thermostat to 165.5° C. and rotating a sample stirring rod at 1,300 rpm to stir for 24 hours, the seizure test was carried out for each oil before and after the test. Similar tests were also carried out for engine oil compositions obtained by only replacing the base oil for the engine oil by a hydrocracked VHVI oil (18.6 cSt at 100° C.) for Examples 47 to 49 and Comparative Examples 12 and 16. These examples are called Examples 47*, 48*, 49* and Comparative Examples 12*, 16*, respectively. The seizure test was carried out under the conditions described above.

TABLE 8

| Lubricating test results | | |
|---|---|---|
| | Farex Test (Seizure Load) | |
| | Before ISOT Test | After ISOT Test |
| Example 47 | 1800 lb | 1300 lb |
| Example 48 | 1750 lb | 1300 lb |
| Example 49 | 1750 lb | 1300 lb |
| Example 47* | 1800 lb | 1500 lb |
| Example 48* | 1750 lb | 1500 lb |
| Example 49* | 1750 lb | 1500 lb |
| Comp. Example 12 | 1050 lb | 550 lb |
| Comp. Example 16 | 1050 lb | 550 lb |
| Comp. Example 12* | 1050 lb | 850 lb |
| Comp. Example 16* | 1050 lb | 900 lb |

It became obvious from the results described above that when the base oil for the engine oil was replaced by the hydrocracked VHVI oil, oxidation stability could be improved.

Effects of the Invention

The first embodiment of the present invention provides an engine oil composition which provides low friction and low wear when it is a new oil, and even at the time of oil degradation, has a large residual MoDTC (A) and hence, provides low friction and low wear for a long term.

The second embodiment of the present invention provides an engine oil composition which provides an excellent coefficient of friction from boundary lubricating condition to fluid lubricating condition.

We claim:

1. An engine oil composition obtained by blending components, including as essential components:

(A) at least one molybdenum dithiocarbamate represented by the following general formula (1):

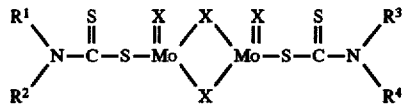

(1)

(wherein each of $R^1$, $R^2$, $R^3$ and $R^4$ may be the same or different and each represent an alkyl group having 8 to 16 carbon atoms, X represents a sulfur atom or oxygen atom, and the ratio of the sulfur atoms to oxygen atoms is from 1:3 to 3:1);

(B) at least one neutral or basic zinc dithiophosphate expressed by the following general formula (2):

$$Zn[(RO)_2PS_2]_2 \cdot aZnO \quad (2)$$

(wherein a is 0 or 1/3 and R represents an alkyl group having 3 to 14 carbon atoms and may be the same or different), wherein the proportion of zinc dithiophosphate containing a primary alkyl group having 8 to 14 carbon atoms, all R's of which may be the same or different, is at least 50 wt. %;

(D) at least one polyglycerin half ester represented by the following general formula (3):

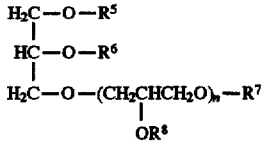

(3)

(wherein n is an integer of $1 \leqq n \leqq 9$, $R^5$ to $R^8$ each represent a hydrogen atom or an acyl group having 8 to 20 carbon atoms with the provision that all of $R^5$ to $R^8$ are never simultaneously either the hydrogen atom or the acyl group, and individually $R^8$'s may be the same or different when n is 2 or more, and the number of acyl groups is expressed as (Y); and (C) a base oil for engine oil;

wherein the proportion of said Component (A) is 0.03 to 1 part by weight, the proportion of said Component (B) is 0.01 to 2 parts by weight, and the proportion of said Component (D) is 0.1 to 5 parts by weight, based on 100 parts by weight of said base oil for engine oil.

2. The engine oil composition according to claim 1, wherein all R's in the general formula (2) are 2-ethylhexyl groups.

3. The engine oil composition according to claim 1, wherein the number (Y) of the acyl groups of the polyglycerin half ester expressed by the general formula (3) is within the range of $1 \leqq Y \leqq (n+5)/2$.

4. The engine oil composition according to claim 3, wherein the proportion of a lauryl group and/or oleyl group in the total acyl groups of the polyglycerin half ester represented by the general formula (3) is at least 25%.

5. The engine oil composition according to claim 1, wherein the proportion of a lauryl group and/or oleyl group in the total acyl groups of the polyglycerin half ester represented by the general formula (3) is at least 25%.

6. The engine oil composition according to claim 5, wherein all the acyl groups of the polyglycerin half ester expressed by the general formula (3) are the lauryl group and/or oleyl groups.

* * * * *